United States Patent [19]

Nakayasu et al.

[11] Patent Number: 4,624,058

[45] Date of Patent: Nov. 25, 1986

[54] FLUIDIZED-BED DRYER

[75] Inventors: Morihiro Nakayasu, Shizuoka; Takekazu Tomizawa, Fujieda; Toshiharu Sugiura, Tokyo, all of Japan

[73] Assignee: Kabushiki Kaisha Okawara Seisakusho, Shizuoka, Japan

[21] Appl. No.: 673,132

[22] Filed: Nov. 19, 1984

Related U.S. Application Data

[63] Continuation of Ser. No. 585,852, Mar. 2, 1984, abandoned.

[30] Foreign Application Priority Data

Mar. 11, 1983 [JP] Japan ..... 58-41170

[51] Int. Cl.[4] ..... F26B 3/08

[52] U.S. Cl. ..... 34/10; 34/56; 34/57 A; 34/214

[58] Field of Search ..... 34/54, 56, 57 A, 214, 34/215, 236, 10, 57 R; 110/245; 122/4 D; 432/58

[56] References Cited

U.S. PATENT DOCUMENTS

| | | | |
|---|---|---|---|
| 3,277,582 | 10/1966 | Munro et al. | 34/57 A |
| 3,295,221 | 1/1967 | Joy | 34/57 A |
| 3,360,867 | 1/1968 | Sanderson | 34/10 |

FOREIGN PATENT DOCUMENTS

| | | | |
|---|---|---|---|
| 108513 | 7/1982 | Japan | 110/245 |

*Primary Examiner*—Albert J. Makay
*Assistant Examiner*—David W. Westphal
*Attorney, Agent, or Firm*—Bucknam and Archer

[57] ABSTRACT

A fluidized-bed dryer includes a vertical fluidized-bed drying chamber divided into at least two sections by at least one vertical partition. Each of the drying chamber sections has an inlet through which wet material is to be introduced into the respective drying chamber section, an outlet through which dry product is to be discharged from the respective drying chamber section, and a horizontal porous supporting shelf for preventing the wet material in the respective drying chamber section from falling during drying. Each drying chamber section is joined with a heated-air chamber through which heated air is introduced into the respective chamber section through the supporting shelf. The individual drying chamber sections operate batchwise repeatedly in staggering manner and independently of each other.

2 Claims, 3 Drawing Figures

FLUIDIZED-BED DRYER

This is a continuation of application Ser. No. 585,852, filed Mar. 2, 1984, now abandoned.

BACKGROUND OF THE INVENTION

1. Field of the Invention

The present invention relates to dryers, and more particularly to a fluidized-bed dryer.

2. Prior Art

Fluidized-bed dryers are grouped into two types: continuous and batch. In continuous fluidized-bed dryers, operation is continued without interruption as long as wet feed or material is successively supplied. A common problem with this continuous type of dryer is that the particles of the succeeding wet feed are mixed with the particles of the preceding wet feed suddenly in the drying chamber, causing non-uniform drying due to the difference between the periods of stay of the particles within the drying chamber.

Batch fluidized-bed dryers operate in the following sequence: (1) wet feed is supplied to the drying chamber; (2) the wet feed is dried, during which time no additional wet feed is supplied; and (3) dry product is discharged from the drying chamber. In this type of dryers, all the particles of wet feed within the drying chamber are dried for a constant period of time, thus causing uniform drying. However, batch fluidized-bed dryers have the following problems, because peripheral equipments or apparatus also must be batch.

1. The succeeding wet feed must be temporarily stocked outside the drying chamber, ready to be supplied, until drying of the preceding wet feed is finished and, subsequently, dry product is discharged from the drying chamber. If the wet feed is adhesive material, the particles of the wet feed in stock would collect into lumps which would tend to be objectionably deformed or otherwise broken due to their own weight during handling. Because of this lumping and misshaping of the particles, adhesive wet feed could not be easily fluidized during drying, and scattering of dust-like particles (of the wet feed) would occur in the drying chamber, resulting in unstable operation and hence inadequate quality product.

2. When a large amount of wet feed (generally, wet feed is poor in fluidity) is supplied at once to the drying chamber, the particles would collect into lumps due to poor fluidity and would stick to a porous supporting shelf and wall surfaces in the drying chamber, causing unstable operation.

3. When wet feed containing alcoholic, acetone or similar organic solution is dried, such solution would vapour suddenly at the beginning of drying and, as a result, there would be a danger that the gas concentration in the drying chamber increases beyond its critical value to explode. For safety, it is necessary to retard the rate of vaporization by lowering the temperature of heated air at the beginning of drying; in this condition, efficient drying cannot be achieved.

SUMMARY OF THE INVENTION

According to the present invention, a fluidized-bed dryer includes a vertical fluidized-bed drying chamber divided into at least two sections by at least one vertical partition. Each of the drying chamber sections has an inlet through which wet material is to be introduced into the respective drying chamber section, an outlet through which dry produt is to be discharged from the respective drying chamber section, and a horizontal porous supporting shelf for preventing the wet material in the respective drying chamber section from falling during drying. Each drying chamber section is joined with a heated-air chamber through which heated air is introduced into the respective chamber section through the supporting shelf. The individual drying chamber sections operate batchwise repeatedly in staggering manner and independently of each other.

It is therefore an object of the present invention to provide a fluidized-bed dryer in which a large amount of wet material can be dried virtually contnuously without non-uniform drying, the stock time of the wet material being reduced to a minimum.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
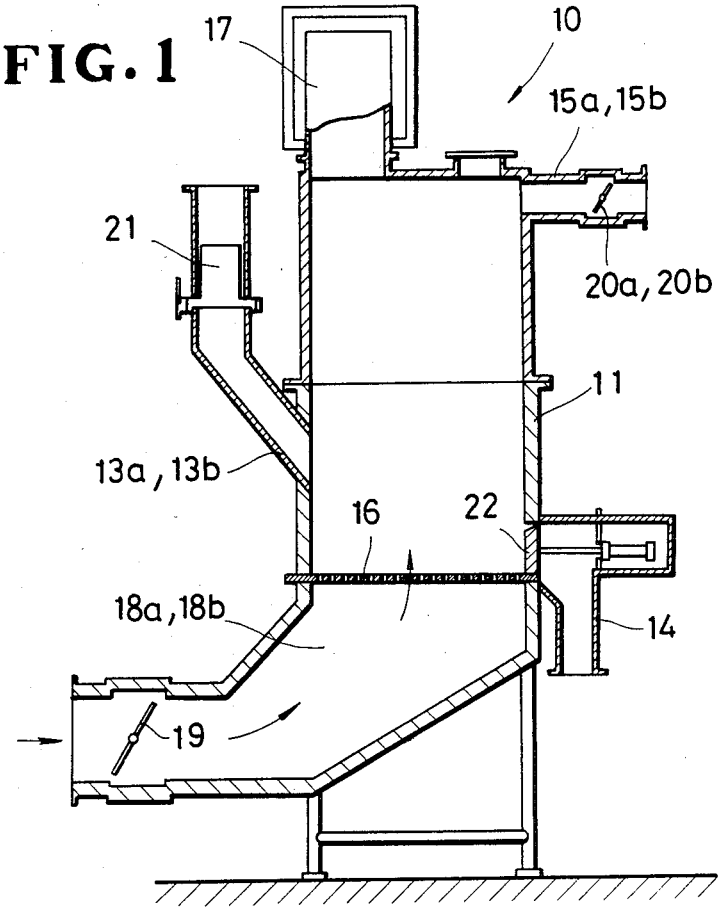
FIG. 1 is a vertical cross-sectional view of a fluidized-bed dryer embodying the present invention.
Figure 2:
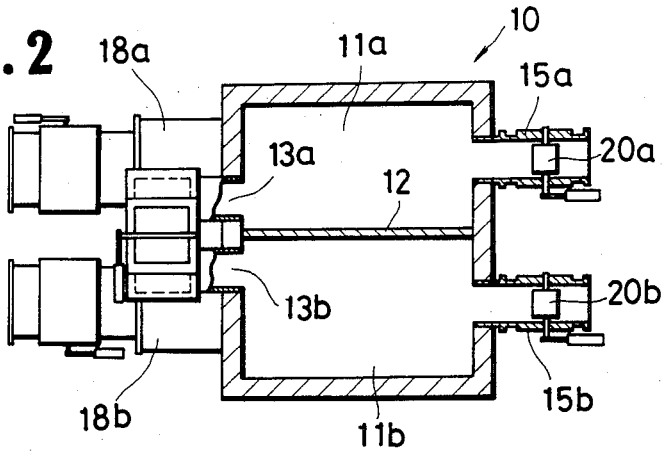
FIG. 2 is a horizontal cross-sectional view of the dryer.
Figure 3:
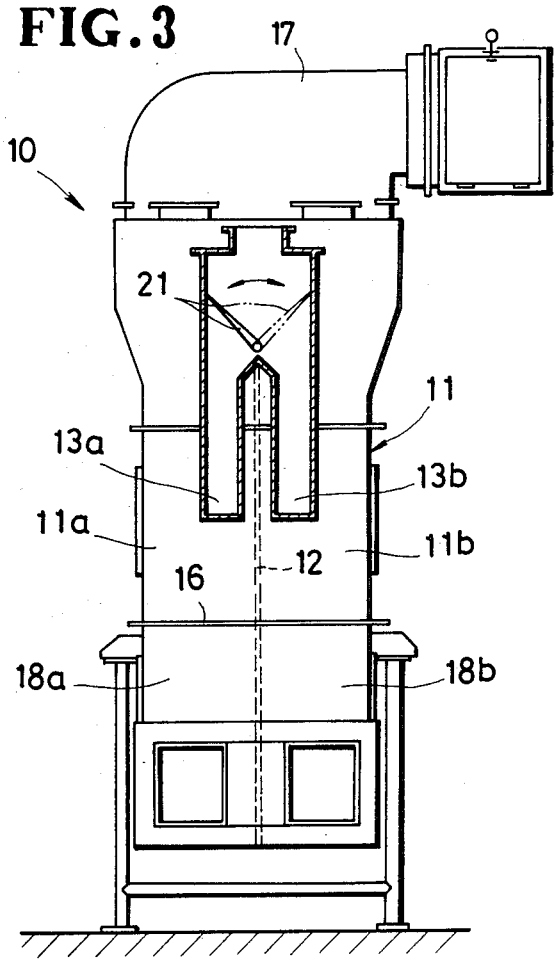
FIG. 3 is a side elevational view, partly in cross section, of the dryer.

The principles of the present invention is particularly useful when embodied in a fluidized-bed dryer (hereinafter referred to as "dryer") such as shown in FIGS. 1 to 3, generally indicated by the numeral 10.

The dryer 10 includes a vertical fluidized-bed drying chamber 11 divided into two sections 11*a*, 11*b* of same size by a central partition 12 extending vertically through the entire height of the drying chamber 11, as shown in FIG. 2. Alternatively, the drying chamber 11 may comprise more than two chamber sections that are separated by more than one partition.

As shown in FIGS. 1 and 2, each of the drying chamber sections 11*a*, 11*b* has an inlet 13*a*, 13*b* through which wet feed or material (not shown) is introduced into the respective drying chamber section 11*a*, 11*b*, and an outlet 14, 14 through which dry product (not shown) is discharged from the respective drying chamber section 11*a*, 11*b*. Each drying chamber section 11*a*, 11*b* also has an exhaust port 15*a*, 15*b* (FIGS. 1 and 2) through which exhaust air is discharged. A horizontal porous supporting shelf 16 (FIG. 1) is mounted within the drying chamber 11 at a bottom end thereof for preventing the wet feed from falling during drying.

The drying chamber 11 communicates at its top end with a safety duct 17 which is normally closed and opens, when the gas pressure in the drying chamber 11 increases over a predetermined value, to allow the gas to escape, thus preventing an explosion due to sudden increase of the gas concentration.

The dryer 10 also includes two heated-air chambers 18*a*, 18*b* each adapted to be connected at one end to a heater and a blower (both not shown) and joined at the other end with a respective of the drying chamber sections 11*a*, 11*b* for introducing heated air into the respective drying chamber section 11*a*, 11*b* through the porous supporting shelf 16.

In operation, a valve 19 of one heated-air chamber 18*a* and a valve 20*a* of one exhaust port 15*a* are opened to introduce heated air into one drying chamber section 11*a*, and then a predetermined amount of wet feed or material is supplied little by little to the drying chamber section 11*a* through one inlet 13*a*, during which time a pivotable distributing plate 21 is in a phantom-line position (FIG. 3). Upon completion of this supply of wet material to one drying chamber section 11*a*, the distributing plate 21 is pivoted to a solid-line position (FIG. 3), and the same amount of wet material is supplied likewise then to the other drying chamber section 11*b* through the other inlet 13*b*, during which time a valve 19 of the other heated-air chamber 18*b* and a valve 20*b* of the other exhaust port 15*b* are opened to intoruduce heated air into the other drying chamber section 112*b* through the poruous supporting shelf 16.

In one drying chamber section 11*a*, fluidized-bed drying is continued for a predetermined period of time, i.e. until the water content of the wet material is reduced to a required percentage, whereupon a gate 22 of one outlet 14 is opened so that the dried material or dry product is removed or discharged from one drying chamber section 11*a*. Meanwhile, the same fluidized-bed drying takes place in the drying chamber section 11*b*.

In each drying chamber section 11*a*, 11*b*, subsequent to removal of the product having been dried in the previous drying, the same cycle of batchwise operation is repeated for drying of the succeeding wet material.

With the fluidized-bed dryer 10, it is poissible to produce adequate quality product which is uniformly dry, because wet material in each drying chamber section 11*a*, 11*b* is dried batchwise in the same condition, with no additional wet material supplied during that drying.

As the two drying chamber section 11*a*, 11*b* operate repeatedly in staggering manner and independently of each other, wet material is supplied little by little to the two drying chamber sections 11*a*, 11*b* alternately to reduce the stock time of the wet material to a minimum. Therefore, wet material can be supplied virtually continuously to the drying chamber 11 without objectionable lumping and misshaping of the particles, guaranteeing stable operation and hence adequate quality product.

Although various minor modifications may be suggested by those versed in the art, it should be understood that we wish to embody whthin the scope of the patent warranted hereon, all such embodiments as reasonably and properly come within the scope of our contribution to the art.

What is claimed is:

1. A process for drying feed containing a liquid comprising the steps of:

(1) introducing a portion of said wet feed into one first section of a vertical fluidized bed drying chamber having a horizontal porous supporting shelf;

(2) introducing hot air into said first section;

(3) exposing said portion of feed to said hot air to effect fluidization and drying thereof until the content of the liquid is reduced to a predetermined amount and a dried portion of feed is obtained;

(4) introducing a second portion of said wet feed into a second section of said vertical fluidized bed drying chamber having a horizontal porous supporting shelf;

(5) removing said dried portion of feed from said first section of the drying chamber;

(6) introducing hot air into said second section to effect drying of the second portion of said wet feed;

(7) introducing a new portion of said wet fed to said first section as in step (1), and removing the second portion of feed after completion of drying from the second section;

(8) repeating said steps (2)–(7) batchwise with successive portions of said wet feed to produce a semi-continuous drying process.

2. A fluidized-bed dryer comprising:

(a) a vertical fluidized-bed drying chamber for drying wet material including at least two sections, at least one vertical partition defining said at least two sections, each of said drying chamber sections having an inlet through which wet material is to be introduced into the respective drying chamber section, an outlet through which dry product is to be discharged from the respective drying chamber section, and a horizontal porous supporting shelf at the bottom end for preventing the wet material in the respective drying chamber section from falling during drying; said outlet being located contiguous to the upper surface of said supporting shelf, an exhaust port for discharging air at the top of each drying chamber section, (b) at least two heated-air chambers at a level lower than said shelf, each adapted to be connected to a blower and joined with its respective drying chamber section for introducing heated air into the respective drying chamber section through said corresponding supporting shelf, each of said drying chamber sections having valve means for opening and closing the inlet of said wet material to each of said drying chamber sections, each valve means of each drying chamber sections engaging the respective heated air chamber of said drying chamber section, a distributing plate pivotable from one first position which opens the valve means of the first drying chamber section and the heated air chamber to said first drying chamber section, to a second position which opens the valve means of said second drying chamber section and the heated air chamber to said second drying chamber section whereby the wet material is dried batchwise alternately in said first drying chamber section and then in said second drying chamber section.

* * * * *